US006557191B2

(12) United States Patent
Bellows et al.

(10) Patent No.: US 6,557,191 B2
(45) Date of Patent: May 6, 2003

(54) BED FRAME

(75) Inventors: William B. Bellows, Wyomissing, PA (US); Paul B. Nelson, Elverson, PA (US); Joshua O. Mullen, Elverson, PA (US)

(73) Assignee: Graco Children's Products Inc., Exton, PA (US)

( * ) Notice: Subject to any disclaimer, the term of this patent is extended or adjusted under 35 U.S.C. 154(b) by 0 days.

(21) Appl. No.: 09/917,780

(22) Filed: Jul. 31, 2001

(65) Prior Publication Data

US 2003/0024045 A1 Feb. 6, 2003

(51) Int. Cl.[7] ..... A47C 19/02

(52) U.S. Cl. ..... 5/200.1; 5/201; 5/285; 5/286; 5/300; 5/425

(58) Field of Search ..... 5/200.1, 201, 285, 5/286, 299, 300, 303, 425

(56) References Cited

U.S. PATENT DOCUMENTS

| | | | | |
|---|---|---|---|---|
| 1,261,893 A | * | 4/1918 | Baldwin | 5/114 |
| 1,851,282 A | * | 3/1932 | Jacobs | 5/286 |
| 3,135,973 A | | 6/1964 | Spencer | |
| 3,383,718 A | | 5/1968 | Spencer | |
| 4,428,086 A | * | 1/1984 | Harris | 5/200.1 |
| 4,734,946 A | * | 4/1988 | Saputo | 5/201 |
| 5,146,631 A | * | 9/1992 | Deal | 5/183 |
| D364,754 S | | 12/1995 | Welsh, Jr. et al. | |
| 5,740,568 A | * | 4/1998 | Elliott | 5/295 |
| 5,996,145 A | * | 12/1999 | Taylor | 5/184 |
| D438,723 S | | 3/2001 | Turner et al. | |
| 6,338,172 B1 | * | 1/2002 | Taylor et al. | 5/184 |

OTHER PUBLICATIONS

Little Tikes Brochure, Cozy Side Rail Toddler Bed/Classic Side Rail Toddler Bed, The Little Tikes Company, 3 pp., 1994.

Evenflo Brochure, "Leading the way in New Baby Products," Evenflo Juvenile Furniture Company, Inc., 1pp.

Lullabye, c1936, p. 26.

Patio Rocking Chair Assembly Instructions, Semco Plastic Company Incorporated, 2 pp., 1997–1999, available at http://www.semcoplastics.com/products/chair.htm.

* cited by examiner

*Primary Examiner*—Michael F. Trettel
(74) *Attorney, Agent, or Firm*—Foley & Lardner

(57) ABSTRACT

A bed frame includes a headboard, a foot board, a right side rail, and a left side rail. Each side rail has a first member and a corresponding second member. Each of the first members is configured to be releasably attached to the headboard solely by mating end joint members formed in the first members and in the headboard, and each of the second members is configured to be releasably attached to the foot board solely by mating end joint members formed in the second members and in the foot board. Each of the first members is configured to be releasably attached to the corresponding second member solely by mating side joint members formed in each of the first members and in the corresponding second members.

33 Claims, 10 Drawing Sheets

BED FRAME

BACKGROUND OF THE INVENTION

This invention relates to a bed frame and, more specifically, to a bed frame for a child that can be easily assembled using fastenerless connections.

Bed frames have long existed. However, traditional bed frames can be improved. Traditional bed frames not only require hardware to connect the side rails to the headboards and foot boards, but they also present storage problems. Long side rails on traditional beds are not easily stored in a closet. Thus, an owner of a traditional bed frame must often store the frame in an attic or basement when the bed is not in use. In addition, the long side rails are not easily shipped to a retail outlet or to a consumer, and purchasers must pay a high freight charge due to the length of the side rails. Further, retailers have both safety and economy of space concerns with respect to the size of a product's carton, especially those retailers who store product cartons on the sales floor.

One commercially available child's bed is easier to ship and store than traditional bed frames. The side rails of this bed frame each comprise two pieces that can be separated to reduce the overall length of the side rails. Although the separability of the side rails makes shipment and storage easier, assembly of the bed frame becomes more complicated. Traditional bed frames are assembled with fasteners, and, each time a bed frame is disassembled and stored, some or all of the fasteners may be misplaced or lost. The two-piece side rails of the above-mentioned child's bed require more fasteners than traditional bed frames and additional assembly steps, and thus requires additional care and attention during assembly.

SUMMARY OF THE INVENTION

Accordingly, there is a need for a bed frame that can be disassembled into parts that are easy to ship and easy to store, that can be assembled using fastenerless connections, and that can be assembled without tools.

The present invention provides a bed frame having a headboard, a foot board, a right side rail, and a left side rail. Each side rail has a first member and a corresponding second member. Each first member is configured to be releasably attached to the headboard solely by mating end joint members formed in the first members and in the headboard, and each second member is configured to be releasably attached to the foot board solely by mating end joint members formed in the second members and in the foot board. Each of the first members also is configured to be releasably attached to a corresponding second member solely by mating side joint members formed in each of the first members and in the corresponding second members. The headboard, the foot board, and the side rails preferably are made of a plastic material. In addition, these plastic bed frame components can be made via blow-molding or rotationally-molding (i.e., roto-molding) techniques, both of which produce strong, hollow plastic components.

According to another aspect of the present invention, a bed frame is provided that includes a headboard, a foot board, right side rail, and a left side rail. Each side rail has a first member releasably attached to the headboard and a corresponding second member releasably attached to the foot board, and each first member is releasably attached to the corresponding second member. In addition, at least one of the first members has a height dimension greater than that of the corresponding second member.

In yet another aspect of the present invention, a bed frame is provided that includes a headboard, a foot board, a right side rail, and a left side rail. Each side rail has a first member and a corresponding second member. The first members are configured to be releasably attached to the headboard by first fastenerless connections formed in the first members and the headboard, and the second members are configured to be releasably attached to the foot board by second fastenerless connections formed in the second members and in the foot board. Further, the first members are configured to be releasably attached to the corresponding second members by third fastenerless connections. In still another aspect of the present invention, the bed frame can include a bracing slat between the second members. The bracing slat is releasably immobilized when the first members are releasably connected to their corresponding second members.

A method of assembling a bed frame in accordance with the invention comprises the steps of (a) providing a foot board, a head board, and first and second side rails, each side rail having a first member and a second member; (b) connecting the second members of the side rails to the foot board via fastenerless connections; (c) releasably connecting a bracing slat between the second members so that the bracing slat extends between the first side rail and the second side rail; (d) connecting the first members of the side rails to the corresponding second members via fastenerless connections so that the bracing slat is releasably immobilized; and (e) connecting the headboard to the first members of the side rails via fastenerless connections.

BRIEF DESCRIPTION OF THE DRAWINGS

These and other features, aspects, and advantages of the present invention will become more apparent from the following description, appended claims, and accompanying exemplary embodiments shown in the drawings, which are briefly described below.

DETAILED DESCRIPTION OF THE PREFERRED EMBODIMENTS

Figure 1:
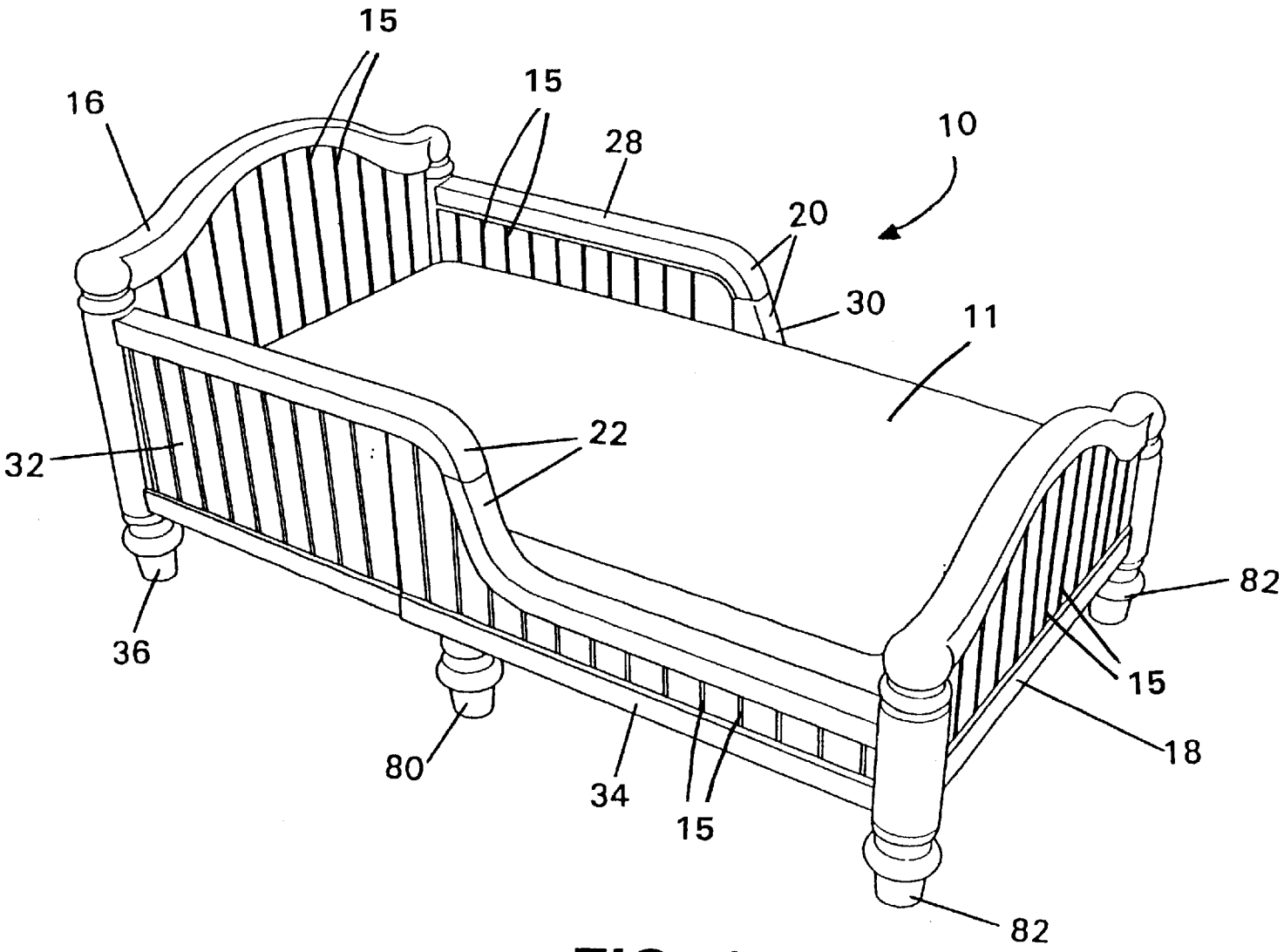
FIG. 1 is a perspective view of a bed frame in accordance with the invention shown having a mattress therein.
Figure 1A:
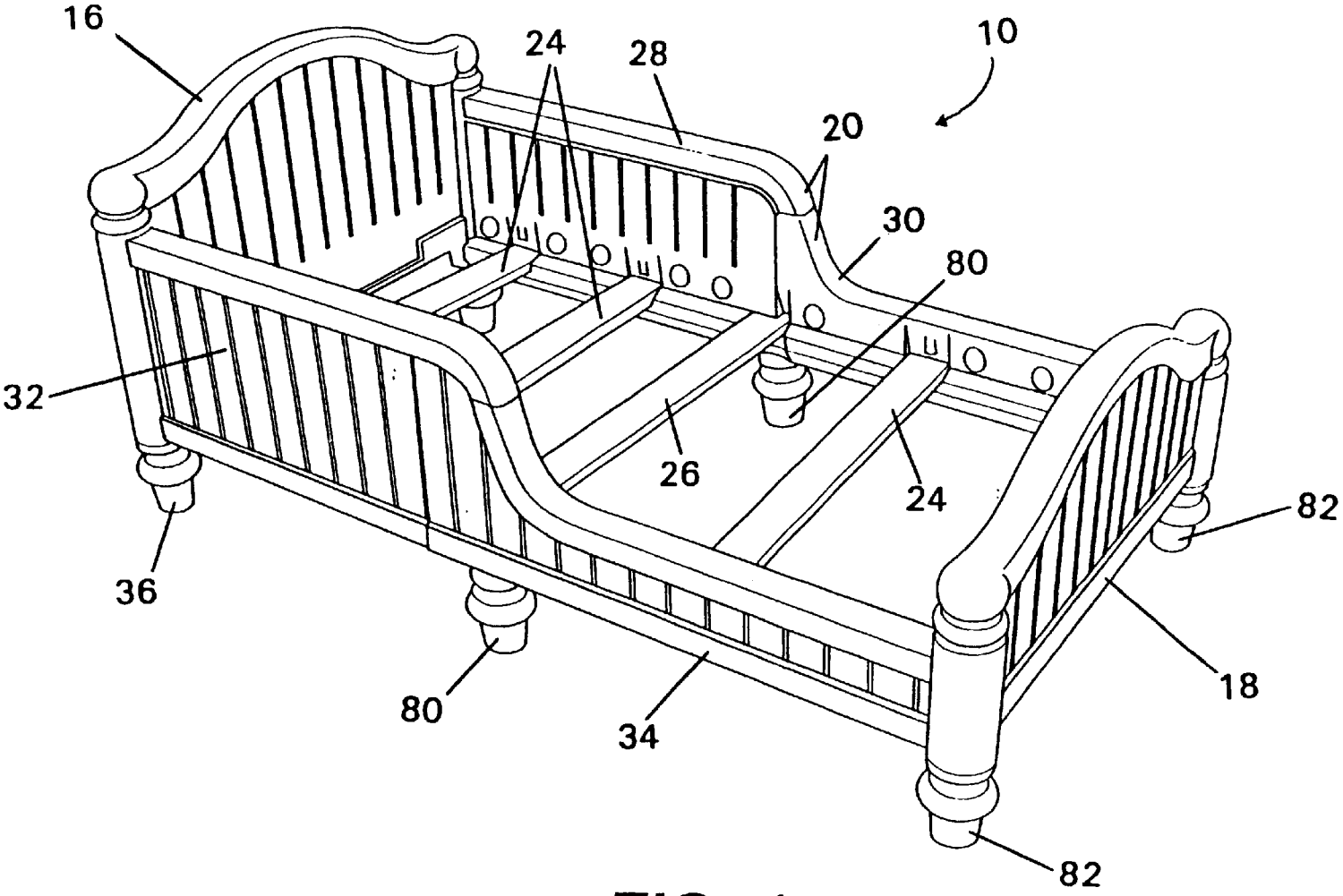
FIG. 1A is a perspective view of the bed frame in FIG. 1 shown without a mattress therein.

FIGS. 1 and 1A show a bed frame 10 in accordance with the invention. The bed frame generally includes a headboard 16, a foot board 18, a right side rail 20, and a left side rail 22. The bed frame 10 also includes slats 24, 26 that support a mattress 11. Each side rail 20, 22 has a first member, or guard rail, 28, 32, and a corresponding second member, or foot rail, 30, 34. As will be explained in more detail below, the guard rails 28, 32 are configured to be releasably attached to the headboard 18 solely by mating end joint members formed in the first members 28, 32 and the headboard 16. Likewise, the foot rails 30, 34 are configured to be releasably attached to the footboard 18 solely by mating end joint members formed in the foot rails 30, 34 and the footboard 18. In addition, each of the guard rails 28, 32 is configured to be releasably attached to the corresponding foot rails 30, 34 solely by mating side joint members formed in the guard rails 28, 32 and foot rails 30, 34. In this regard, the bed frame 10 is assembled via fastenerless connections formed in and by the bed frame component parts themselves. Assembly of the bed frame 10 of the present invention thus does not require screws, nails, dowels, adhesive, rivets, nuts, bolts, spot welds, or other fasteners, which can be lost and/or which add complexity to assembly/disassembly of the bed frame. Moreover, as the bed frame construction is fastenerless, tools associated with particular fasteners (e.g., screwdrivers associated with screws) are not necessary to assemble the bed frame. Accordingly, assembly and disassembly of the bed frame 10 of the present invention is simple and efficient.

Another feature of the bed frame 10 of the present invention is that the bed frame 10 is constructed to allow a child to easily climb into bed and, at the same time, to reduce the likelihood that a child will roll off of the bed onto the floor. As seen in FIGS. 1 and 1A, the guard rails 28, 32 have a height dimension greater than the height dimension of the foot rails 30, 34. A child can crawl onto the mattress 11 over the foot rail 30, 34, yet the guard rails 28, 32, which extend above the plane of the mattress 11, prevent a sleeping child from rolling out of the bed.

The bed frame components preferably are made of a plastic material, which, as compared to other materials suitable for bed frames, weighs and costs less. These plastic bed frame components can be blow-molded or, alternatively, rotationally-molded (i.e., roto-molded). The plastic bed frame components can be molded to include decorative features, such as vertical grooves 15 molded into the interior and exterior surfaces of headboard, side rails, and foot board of FIG. 1. Although slats 24, 26, can be made of plastic, they alternatively can be made of wood, as wooden slats are less expensive to manufacture than blow-molded or roto-molded slats.

The component parts of the bed frame 10 will now be described in more detail. As mentioned above, the bed frame 10 generally includes a headboard 16, a foot board 18, a right side rail 20, a left side rail 22, and a plurality of slats 24, 26. The right side rail 20 is formed by attaching a first member, or guard rail, 28 and a second member, or foot rail, 30 together. Similarly, the left side rail 22 is formed by attaching a first member, or guard rail, 32 and a second member, or foot rail, 34 together. Although only one guard rail 32 or foot rail 34 may be discussed below, that discussion also can apply to the other guard rail 28 and foot rail 30.

Connection of the guard rails 28, 32 to the headboard 16 will now be described. The guard rails 28, 32 and the headboard 16 each include end joint members that matingly engage to attach the guard rails 28, 32 to the headboard 16. These end joint members can form a dovetail joint, a pin-in-socket joint, or a combination of both. The embodiment shown in FIGS. 1–8 includes both a dovetail joint and a pin-in-socket joint. More specifically, referring to FIGS. 2 and 5, the guard rail 32 includes a leg post 36 positioned at an end of the guard rail 32 adjacent the headboard 16. The guard rail 32 includes an end joint member (or fastenerless connector) integrally formed in the guard rail 32 above the leg post 36. In the embodiment of FIGS. 1–8, the end joint member is a dovetail mortise 38. This dovetail mortise 38 mates with an end joint member formed in the headboard 16, namely, a dovetail tenon 44 as seen in FIG. 6, to form a dovetail joint. Throughout this specification, "dovetail joint" can be defined as a joint comprised a dovetail mortise on one component of the bed frame 10 and a corresponding dovetail tenon on another component of the bed frame 10 to which the one component is to be connected. The dovetail mortise 38 can be substantially trapezoidal in shape; the narrower side of the trapezoid is exposed, whereas the longer side of the trapezoid is formed in the guard rail 32 (i.e., the mortise tapers outward). The orientation of the sides of the trapezoid creates the dovetail mortise 38, which can releasably engage the dovetail tenon 44 formed along one end of the headboard 16.

Figure 5:
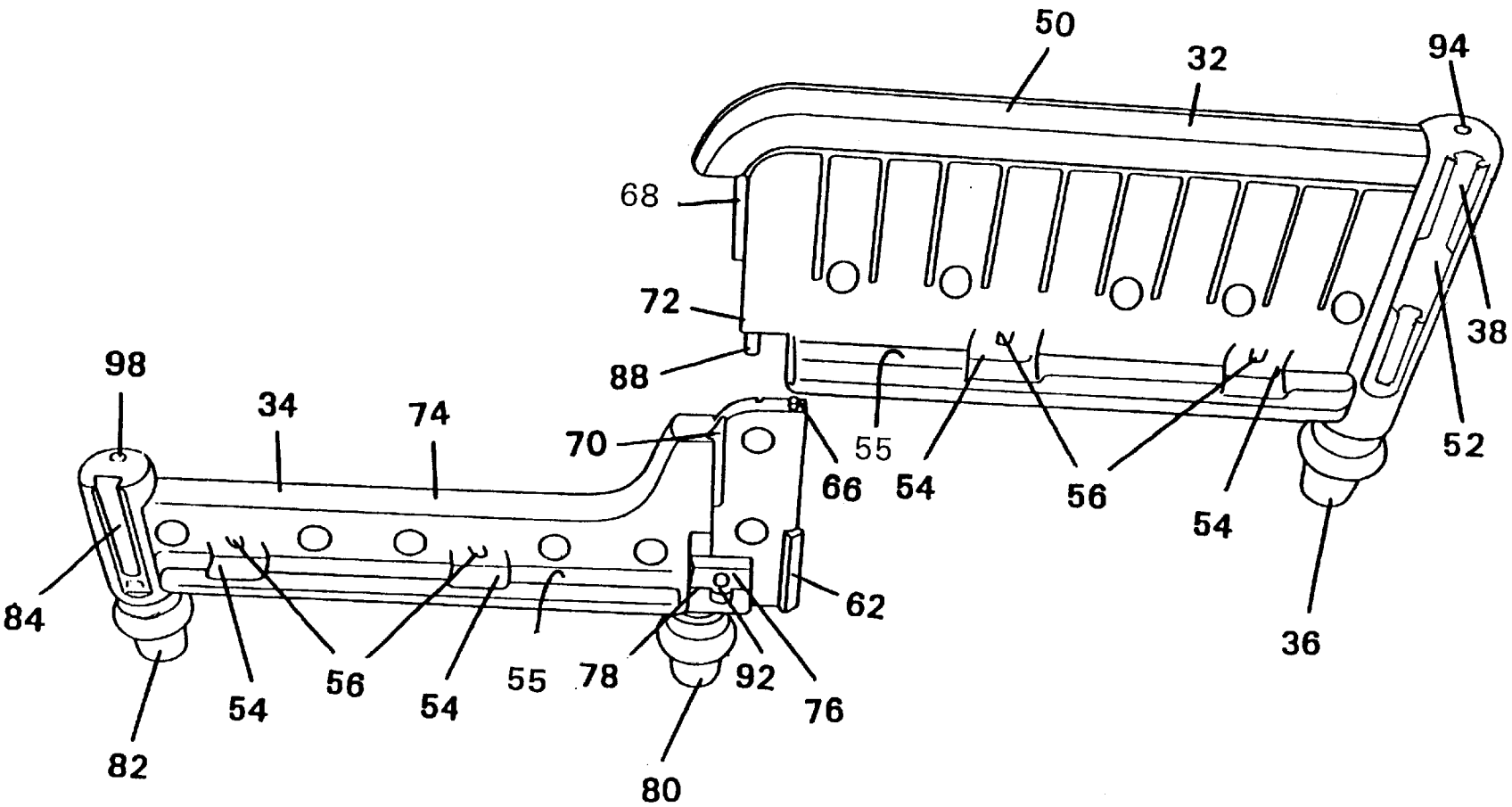
FIG. 5 is an enlarged, exploded, top perspective view of a side rail of the bed frame, viewed from interior of the bed frame.
Figure 6:
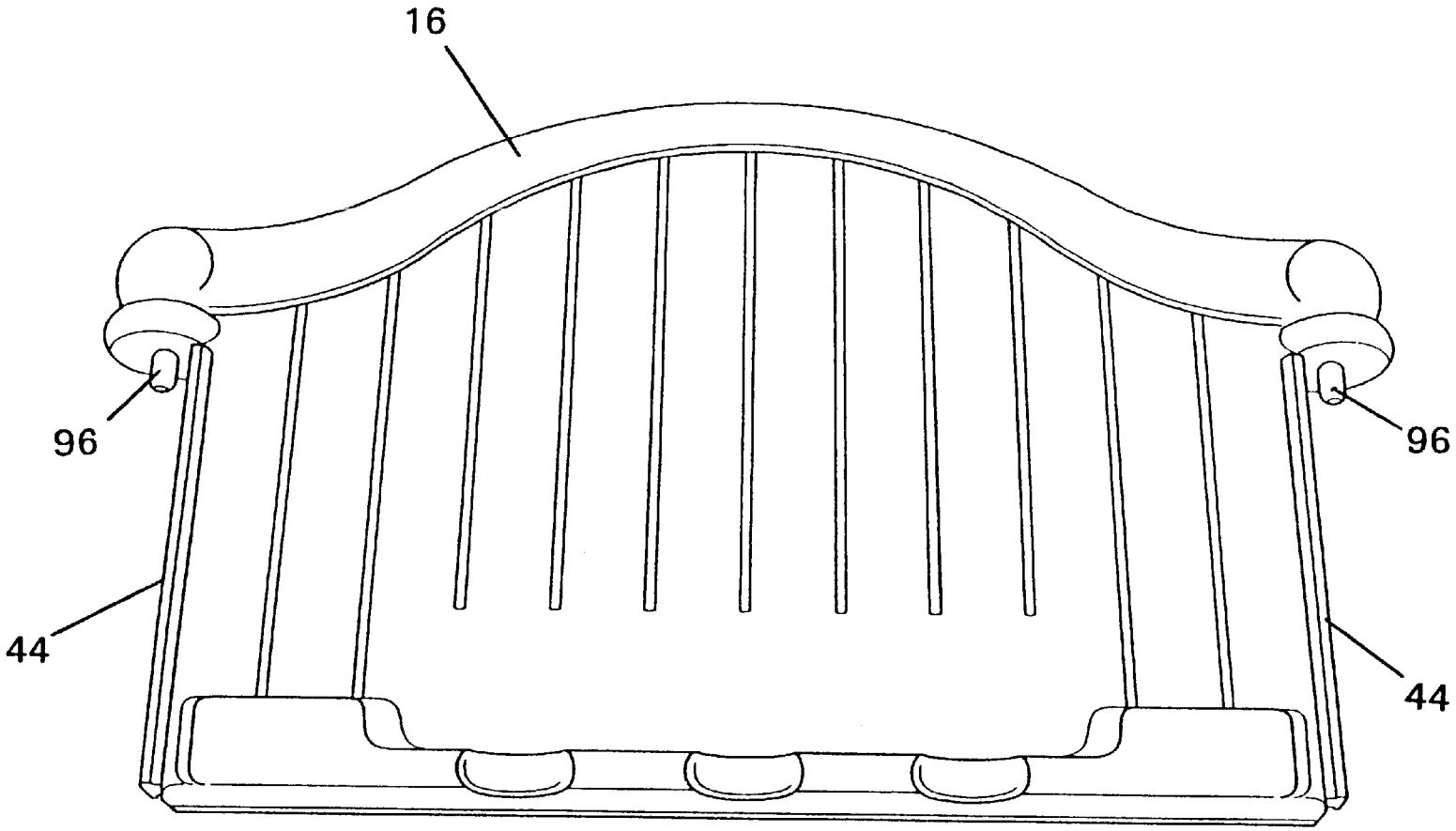
FIG. 6 is a bottom perspective view of an end of the headboard, viewed from interior of the bed frame.

Referring to FIG. 5, the guard rail 32 also includes a socket 94 on its upper surface 50. The socket 94 is sized to receive a pin 96, as shown in FIG. 6, that extends downwardly from a post at a corresponding end of the headboard 16 to form a "pin-in-socket joint." Throughout this specification, "pin-in-socket joint" can be defined as a joint comprised of a pin on one component of the bed frame 10 and a corresponding socket on another component of the bed frame 10 to which the one component is to be connected. The end joint that releasably attaches the first members, or guard rails, 28, 32, to the headboard 16 thus can include a dovetail joint and a pin-in-socket joint. This end joint is fastenerless.

Figure 4:
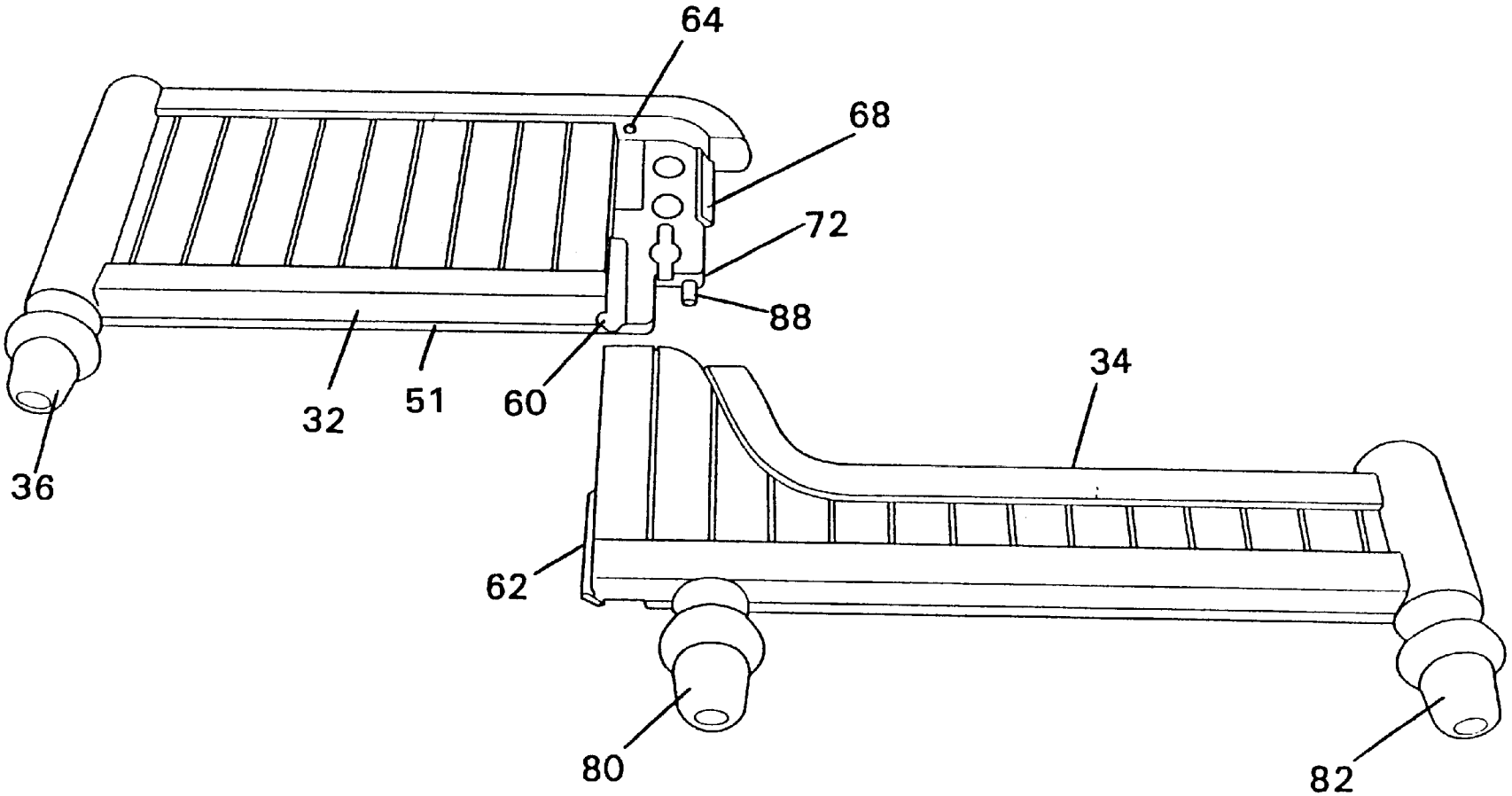
FIG. 4 is an enlarged, exploded, bottom perspective view of a side rail of the bed frame, viewed from exterior of the bed frame.

FIGS. 4 and 5 illustrate how the guard rails and foot rails of the side rails are configured for fastenerless connection. The guard rails 28, 32 and foot rails 30, 34 include mating side joint members that form a side joint between the respective guard rails and foot rails. Each guard rail 28, 32 includes side joint members (or fastenerless connectors) at an end opposite its leg post 36 for mating attachment to side joint members (or fastenerless connectors) formed in the corresponding foot rail 30, 34. In this regard, referring to FIGS. 4 and 5, the guard rail 32 includes a mortise 60 that opens to a bottom surface 51 of the guard rail 32, and the foot rail 34 includes a tenon 62 integrally formed thereon for mating engagement with the mortise 60. The mortise 60 preferably is oriented at an angle with respect to a plane defined by the guard rail 32. In addition, the guard rail 32 includes an angled tenon 68, as shown in FIG. 4, for mating engagement with a mortise 70, as shown in FIG. 5, that opens to a top surface 74 of the foot rail 34. Like mortise 60, this mortise 70 preferably is oriented at an angle with respect to a plane defined by the foot rail 34.

In addition to forming dovetail joints via mortise members 60, 70 and tenon members 62, 72, the guard rail 32 and the foot rail 34 can further include a pin-in-socket joint. As best seen in FIG. 4, guard rail 32 includes a socket 64 formed substantially above angled mortise 60, and, as best seen in FIG. 5, foot rail 34 includes an upwardly extending pin 66 on its upper surface 74 to mate with socket 64 to form a pin-in-socket joint. The combination of the dovetail joints and the pin-in-socket joint enables the guard rail 32 and the corresponding foot rail 34 to be secured together via fastenerless connection.

Figure 7:
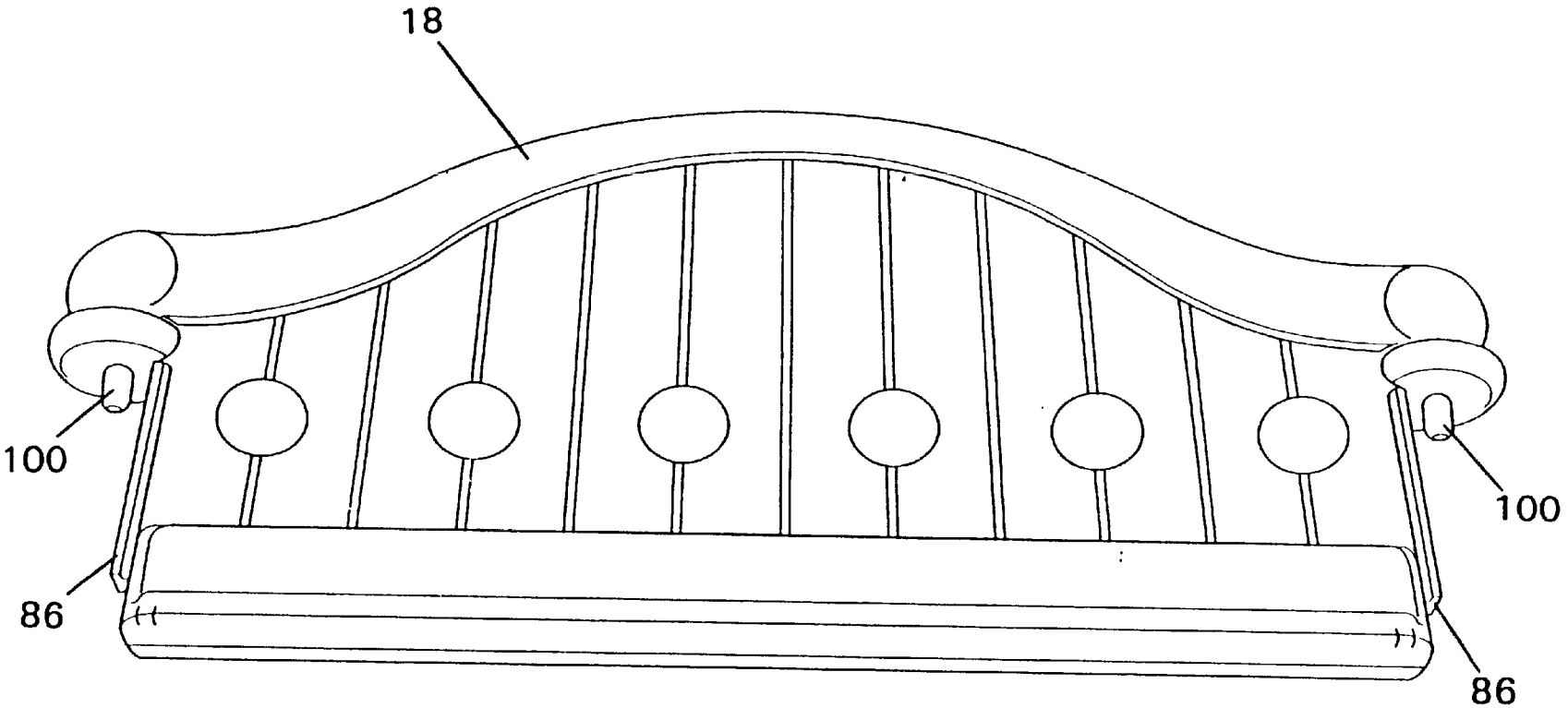
FIG. 7 is a bottom perspective view of an end of the foot board, viewed from interior of the bed frame.
Figure 8:
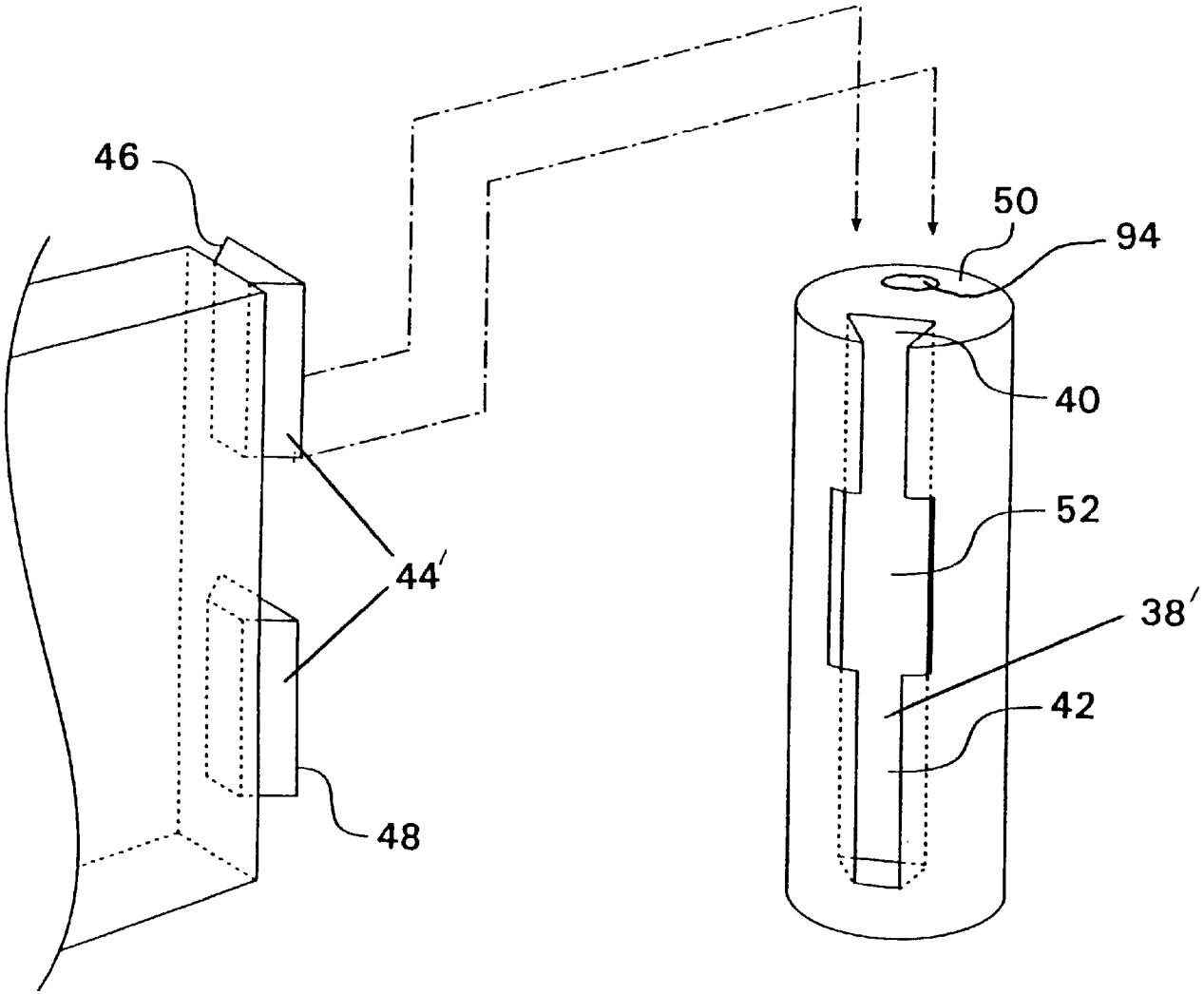
FIG. 8 is a perspective view of an alternative dovetail joint which may be used in any of the fastenerless connections of the bed frame.

Referring to FIGS. 5 and 7, connection of the foot rails 30, 34 to the foot board 18 will now be discussed. The foot rails 30, 34 and the foot board 18 each include end joint members that matingly engage to attach the foot rails 30, 34 to the foot board 18. These end joint members can form a dovetail joint, a pin-in-socket joint, or a combination of both. The embodiment shown in FIGS. 1–8 includes both a dovetail joint and a pin-in-socket joint. More specifically, the foot rail 34 includes an end joint member (or fastenerless connector) integrally formed in the foot rail 34 above a leg post 82. In the embodiment of FIGS. 1–8, the end joint member is a dovetail mortise 84. This dovetail mortise 84 mates with an end joint member formed in the foot board 18, namely, dovetail tenon 86, to form a dovetail joint. The foot rail 34 also includes a socket 98 on its upper surface 74. The socket 98 is sized to receive a pin 100 that extends downwardly from a post at a corresponding end of the foot board 18 to form a pin-in-socket joint. In this manner, the end joints formed between the foot rails 30, 34 and the foot board 18 are fastenerless.

The bed frame 10 includes a bracing slat 26 that ties the side rails 20, 22 together. Without the bracing slat 26, outward pressure exerted on the plastic side rails 20, 22 could bow the side rails 20, 22 outward to an extent sufficient to dislodge slats 24 from their respective slat receiving members 54, thereby causing the mattress 11 to fall to the floor. As seen in FIG. 2A, the bracing slat 26 has bores 90 on its opposite ends. Each guard rail 28, 32 includes a pin 88, seen best in FIG. 4, that extends downwardly from a locking corner 72 and that is dimensioned to fit within bore 90. The foot rails 30, 34, in turn, each include a slot 76 that defines a ledge 78, as seen in FIG. 5. An end of the bracing slat 26 can be fit into the slot 76 to rest upon the ledge 78. After the bracing slat 26 is inserted into the slot 76, the guard rail 28, 32 can be attached to the corresponding foot rail 30, 34. When the guard rail 28, 32 and foot rail 30, 34 are attached, the pin 88 that protrudes downwardly from the locking corner 72 of the guard rail 28, 32 is inserted through the bore 90 in the bracing slat 26 and into a socket 92 formed in ledge 78, thereby locking the bracing slat 26 into the slot 76. The connection between the bracing slat 26, the pin 88 on the guard rail 28, 32, and the socket 92 in the foot rail 30, 34 prevents the side rails 20, 22 from bowing outwardly.

In addition to the headboard 16, the foot board 18, the side rails 20, 22, and the bracing slat 26, the bed frame 10 includes several slats 24 for supporting the mattress 11. The embodiment of FIGS. 1–8 has four slats 24; however, it will be understood that the bed frame of the present invention can include fewer than four slats (for example, two slats, one on either side of bracing slat 26) or more than four slats. To secure the slats 24 to the bed frame 10, both the guard rails 28, 32 and the foot rails 30, 34 include slat receiving members 54 formed in lower ledges 55 of the rails 28, 30, 32, 34. The slat receiving members 54 preferably comprise wells 58 and corresponding catches 56. The wells 58 are formed in the ledges 55, and the catches 56 extend out from an interior side of the rails 28, 30, 32, 34 above the wells 58. The catches 56 hold the ends of the slats 24 in their corresponding wells 58, as shown in FIG. 1A. When a mattress 11 is placed in the bed frame 10, the ledges 55, the slats 24, and bracing slat 26 support the mattress.

Figure 2:
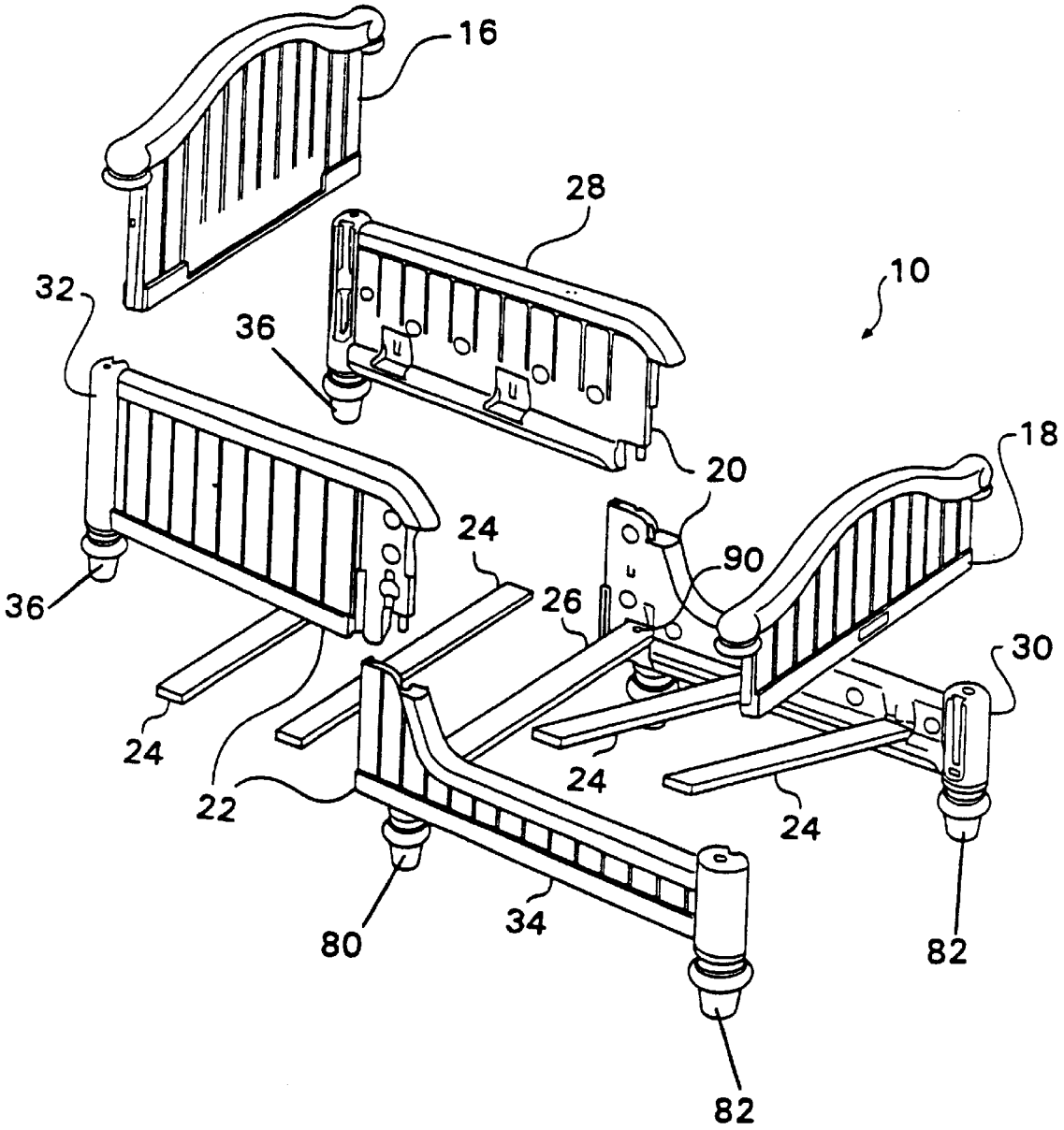
FIG. 2 is an exploded view of the bed frame.
Figure 2A:
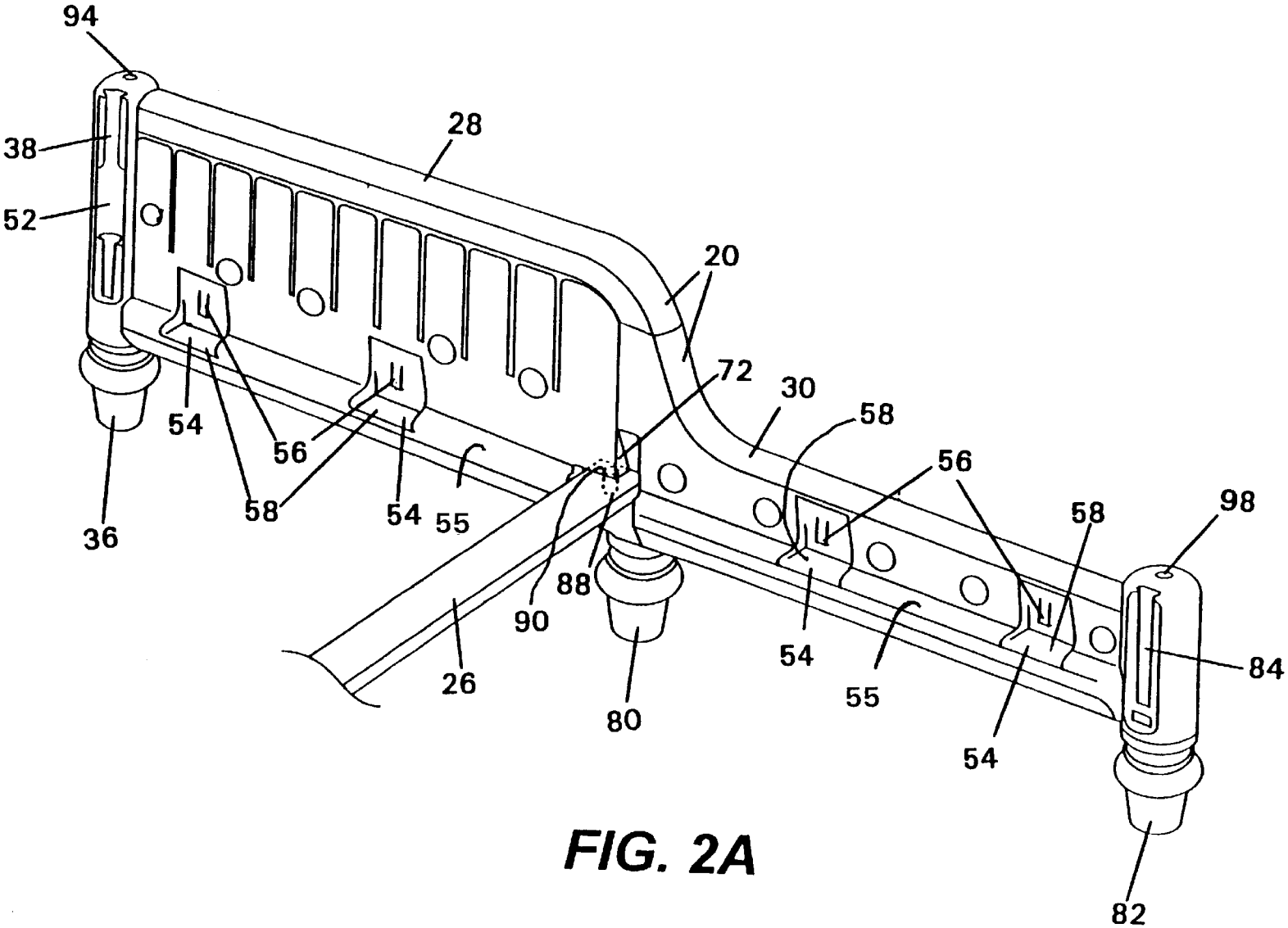
FIG. 2A is an enlarged perspective view of a side rail of the bed frame in FIG. 1.
Figure 3:
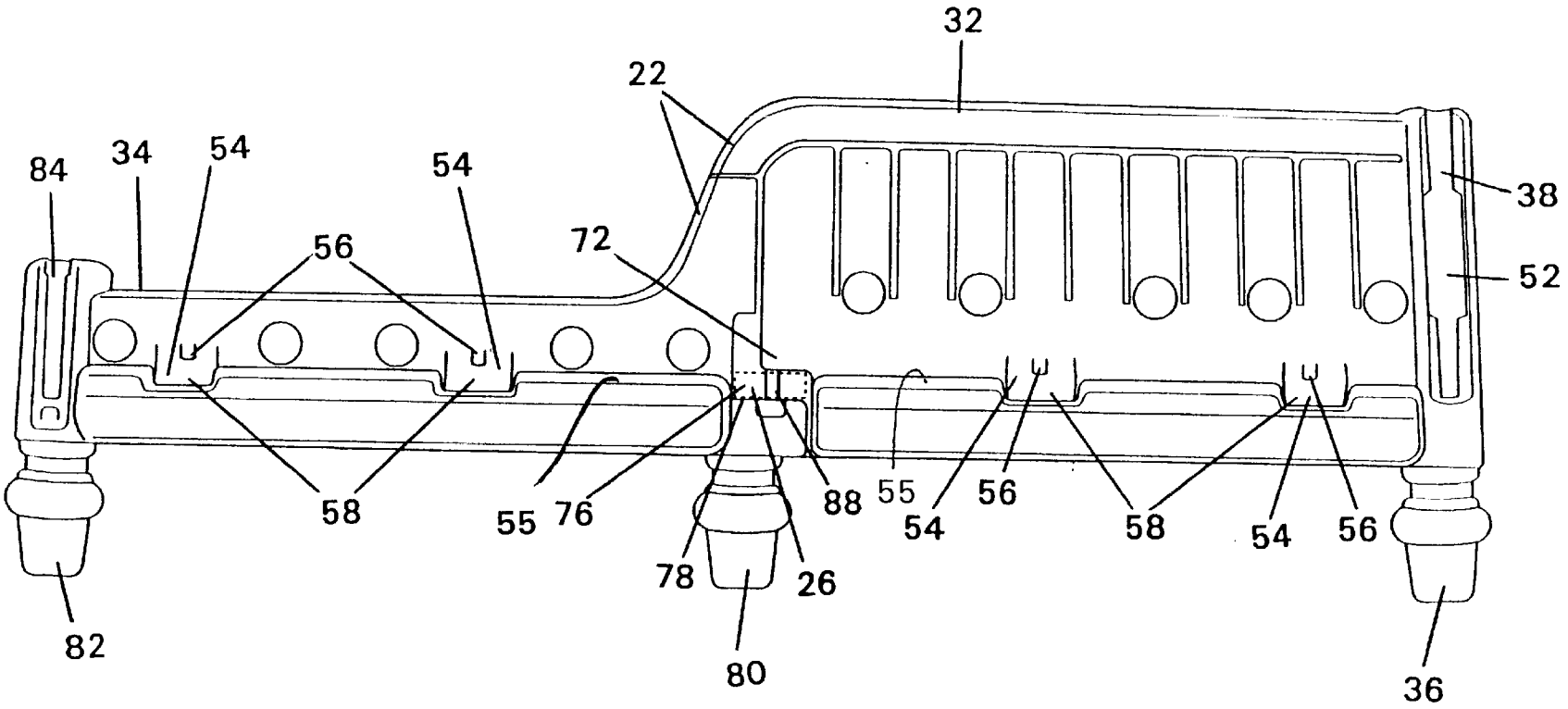
FIG. 3 is a side elevation view of a side rail of the bed frame.

Referring to FIG. 2, it will be seen that the guard rails 28, 32 each include one leg post 36, and the foot rails 30, 34 each include two leg posts 80, 82, one at either end of the foot rails 30, 34. Leg posts 36 and 80 are spaced apart a distance approximately equal to the distance between leg posts 80 and 82 so that weight is distributed evenly across the bed frame. In alternative embodiments, the leg posts may be spaced apart differently than shown in FIGS. 1–8.

In the embodiment of FIGS. 1–8, the fastenerless connection between the guard rails 28, 32 and their corresponding foot rails 30, 34 occurs at the midpoint of the side rails 20, 22. The bracing slat 26 thus bisects the interior area of the bed frame 10. It will be understood, however, that the guard rails 28, 32 can be longer than the foot rails 30, 34, or vice versa, so that their connection occurs closer to the foot board 18 or the headboard 16, as desired.

FIG. 6 is a bottom perspective view of the headboard 16. As described above, the headboard 16 includes inwardly tapering, dovetail tenons 44, which are configured to engage mortises 38 on the ends of the guard rails 28, 32. In addition, pins 96 are shown extending downward from posts at opposite ends of the headboard 16. The pins 96 are sized to fit in sockets 94 on the upper surface 50 of the guard rails 28, 32.

FIG. 7 is a bottom perspective view of the foot board 18. As described above, the foot board 18 includes inwardly tapering, dovetail tenons 86, which are adapted to engage the mortises 84 on the ends of the opposing foot rails 30, 34. In addition, pins 100 are shown extending downward from posts at opposite ends of the foot board 18. The pins 100 are sized to fit in sockets 98 in the upper surface 74 of the foot rails 30, 34.

The above-described embodiment of the bed frame 10 is not intended to be limiting. Accordingly, in an alternative embodiment, for example, the fastenerless dovetail joints can be modified. Although an example of such a modified joint will be explained with respect to the dovetail joint that connects a guard rail to the headboard, it should be appreciated that similar modification can be made to any of the dovetail joints described herein. In this alternative embodiment shown in FIG. 8, mortise 38' can extend from the upper surface 50 of the guard rail 28 down to a position above the leg post 36. The mortise 38' can include a gap 52 that allows for two separate portions 46, 48 of tenon 44' to be inserted into the mortise 38' at the same time. One of the tenon portions 46 can be positioned above the upper surface 50 and then can be slid into an upper portion 40 of the mortise 38', and the other tenon portion 48 can be inserted into the gap 52 and then can be slid into a lower portion 42 of the mortise 38'.

In another alternative embodiment, the respective locations of the joint members comprising the dovetail joints and/or the pin-in-socket joints can be switched. By way of example only, the pin 66 shown in FIG. 5 on the foot rail 34 can be switched to the guard rail 32, and the socket 64 shown in FIG. 4 on the guard rail 32 can be switched to the foot rail 34. Similar switches could be made at other joints of the bed frame 10.

Assembly of the bed frame in accordance with an embodiment of the invention will now be described. Initially, the foot rails 30, 34 are connected to the foot board 18 via fastenerless connections. More specifically, the dovetail tenons 86 of the foot board 18 are inserted into corresponding dovetail mortises 84 in the end of the foot rails 30, 34. As this connection is completed, the downwardly extending pins 100 in the foot board 18 are inserted into the sockets 98 in the foot rails 30, 34. Next, the bracing slat 26 is inserted into the slots 76 in each of the foot rails 30, 34. Insertion of the bracing slat 26 may require a slight outward bending of the two foot rails 30, 34 with respect to the foot board 18 so as to provide an opening wide enough for the bracing slat 26 to be positioned in each of the slots 76. After the bracing slat 26 is inserted into the slots 76 in the foot rails 30, 34, the guard rails 28, 32 are slid onto their respective foot rails 30, 34.

When guard rail 28 is slid onto foot rail 30: (a) the angled tenon 62 of the foot rail 30 slides into the angled mortise 60 of the guard rail 28; (b) the pin 66 on the upper surface 74 of the foot rail 30 engages the socket 64 in the guard rail 28; (c) the angled tenon 68 protruding from the guard rail 28 slides into the angled mortise 70 in the foot rail 30; and (d) the downwardly protruding pin 88 extending below the locking corner 72 of the guard rail 28 slides into the bore 90 in the bracing slat 26 and then into the socket 92 of the foot rail 34. Similar fastenerless connections are made when guard rail 32 is slid onto foot rail 34.

At this time, the headboard 16 is slid onto the guard rails 28, 32. The headboard engages the guard rails 28, 32 via its two dovetail tenons 44, which slide into corresponding dovetail mortises 38 on each of the guard rails 28, 32. In addition, downwardly protruding pins 96 of the headboard 16 slide into the sockets 94 in the guard rails 28, 32. Finally, two slats 24 are inserted into the slat receiving members 54 in the foot rails 30, 34, and two slats 24 are inserted into the slat receiving members 54 in the guard rails 28, 32. Insertion of these slats 24 may require slight force to properly position them in the appropriate slat-receiving members 54. The bed frame 10 shown in FIG. 1A is now complete.

In an alternative method of assembly, the bed owner may: (a) connect the foot rails 30, 34 to the foot board 18; (b) insert slats 24 into slat receiving members 54 in the foot rails 30, 34; (c) insert the bracing slat 26 into the respective slots 76 in each of the foot rails 30, 34; (d) connect the guard rails 28, 32 to their respective foot rails 30, 34; (e) insert slats 24 into the slat receiving members 54 in the guard rails 28, 32; and (f) finally, connect the headboard 16 to the guard rails 28, 32. In this method, the slats 24 are inserted into place earlier in the assembly process.

As mentioned above, in an alternative embodiment of the invention, the joint members on the guard rails 28, 32 and their corresponding foot rails 30, 34 can be reversed. For example, to accomplish fastenerless connection of guard rail 32 to foot rail 34, the mortise 60 and the tenon 68 of the guard rail 32 of FIG. 4 can be switched with the tenon 62 and mortise 70 of the foot rail 34 of FIG. 5. In addition, guard rail 32 can include a slot to receive the bracing slat and a ledge with a socket, while foot rail 34 can include a locking corner and a pin adapted to fit in the socket. Similar switches can be made in guard rail 28 and foot rail 30. In such an alternative embodiment, assembly of the bed frame 10 can be accomplished by first connecting the guard rails to the headboard, then inserting the bracing slat into respective slots in each of the guard rails, connecting the foot rails to the guard rails, and connecting the footboard to the foot rails. The steps in this method of assembly occur in a generally reverse order as compared to the assembly methods discussed above.

In the aforementioned method and alternatives thereto, the fastenerless connections can be achieved using a variety of possible connective joints including, but not limited to, dovetail joints, pin-in-socket joints, or combinations of dovetail joints and pin-in-socket joints.

A bed frame assembled using fastenerless connections has been described according to the present invention. In addition, a method of assembling the bed has also been described. Modifications and variations may be made to the bed frame and bed frame assembly method described and illustrated herein without departing from the spirit and scope of the invention. Accordingly, it should be understood that the structure and method described herein are illustrative only and are not limiting upon the scope of the invention.

What is claimed is:

1. A bed frame comprising:

a headboard;

a foot board; and a right side rail and a left side rail, each side rail having a first member and a second member, wherein each of the first members is configured to be releasably attached to the headboard solely by mating end joint members formed in the first members and in the headboard, wherein each of the second members is configured to be releasably attached to the foot board solely by mating end joint members formed in the second members and in the foot board, wherein each of the first members is configured to be releasably attached to the corresponding second member solely by mating side joint members formed in each of the first members and in the corresponding second members, and wherein the first members each have a height dimension greater than that of the respective second members and serve as a guard rails.

2. The bed frame according to claim 1, wherein the mating side joint members form a side joint are selected from the group consisting of a dovetail joint, a pin-in-socket joint, and a combination of dovetail joint and a pin-in-socket joint.

3. The bed frame according to claim 1, wherein the mating side joint members form a plurality of dovetail joints.

4. The bed frame according to claim 3, wherein the plurality of dovetail joints are oriented at an angle with respect to a plane defined by the respective side rail.

5. The bed frame according to claim 4, wherein the mating side joint members also form a pin-in-socket joint.

6. The bed frame according to claim 1, wherein the second members of the side rails each have a slot adapted to receive an end of a slat so that the slat extends between the second members.

7. The bed frame according to claim 6, wherein the first members of the side rails each have a locking corner adapted to lock the slat into the respective slot.

8. The bed frame according to claim 6, wherein the first members of the side rails each have a pin extending downwardly from the respective locking corner, and wherein the slat has a bore at either end to receive the respective pin, thereby locking the slat into the slots of the second members.

9. The bed frame according to claim 8, wherein the second members of the side rails each have a socket formed in the slot to receive the pin of the respective first members.

10. The bed frame according to claim 1, wherein the headboard, the foot board, the right side rail, and the left side rail are made of a plastic material.

11. The bed frame according to claim 10, wherein the plastic material is selected from the group consisting of blow-molded plastic and rotationally-molded plastic.

12. The bed frame according to claim 1, wherein the mating end joint members that releasably attach the first member to the headboard form an end joint selected from the group consisting of a dovetail joint, a pin-in-socket joint, and a combination of dovetail joint and a pin-in-socket joint.

13. The bed frame according to claim 1, wherein the mating end joint members that releasably attach the second member to the foot board form an end joint selected from the group consisting of a dovetail joint, a pin-in-socket joint, and a combination of dovetail joint and a pin-in-socket joint.

14. A bed frame comprising:

a headboard;

a foot board; and a right side rail and a left side rail, each side rail having a first member and a second member, wherein each of the first members is configured to be releasably attached to the headboard solely by mating end joint members formed in the first members and in the headboard, wherein each of the second members is configured to be releasably attached to the foot board solely by mating end joint members formed in the second members and in the foot board, wherein each of the first members is configured to be releasably attached to the corresponding second member solely by mating side joint members formed in each of the first members and in the corresponding second members, wherein the first members and the second members each have a plurality of slat receiving members formed on an interior side thereof, wherein the slat receiving members each comprise a well and a corresponding catch, and wherein, when an end of a slat is positioned in one well, the corresponding catch locks the end of the slat into the one well.

15. A bed frame comprising:

a headboard;

a foot board; and a right side rail and a left side rail, each side rail having a first member releasably attached to the headboard and a corresponding second member releasably attached to the foot board, the first members being releasably attached to the corresponding second members;

wherein at least one of the first members has a height dimension greater than that of the corresponding second member.

16. The bed frame according to claim 15, wherein the headboard, the foot board, the right side rail, and the left-side rail are formed of a plastic material.

17. The bed frame according to claim 15, wherein the plastic material is selected from the group consisting of blow-molded plastic and rotationally-molded plastic.

18. The bed frame according to claim 15, wherein the first members of the right side rail and the left side rail are releasably attached to the headboard by a first set of fastenerless connections, and wherein the second members of the right side rail and the left side rail are released attached to the foot board by a second set of fastenerless connections.

19. The bed from according to claim 18, wherein the first and second sets of fastenerless connections are selected from the group consisting of dovetail joints, pin-in-socket joints, and combinations of dovetail joints and pin-in-socket joints.

20. A bed frame comprising:

a headboard;

a foot board;

a right side rail and a left side rail, each side rail having a first member and a corresponding second member, wherein the first members are configured to be releasably attached to the headboard by first fastenerless connections formed in the first members and the headboard, wherein the second members are configured to be releasably attached to the foot board by second fastenerless connections formed in the second members and the foot board, wherein the first members are configured to be releasably attached to the corresponding second members by third fastenerless connections, and wherein the first members have a height dimension greater than that of the corresponding second members.

21. The bed frame according to claim 20, wherein the first fastenerless connections are selected from the group consisting of a dovetail joint, a pin-in-socket joint, and a combination of a dovetail joint and a pin-in-socket joint.

22. The bed frame according to claim 20, wherein the second fastenerless connections are selected from the group consisting of a dovetail joint, a pin-in-socket joint, and a combination of a dovetail joint and a pin-in-socket joint.

23. The bed frame according to claim 20, wherein the third fastenerless connections are selected from the group consisting of a dovetail joint, a pin-in-socket joint, and a combination of a dovetail joint and a pin-in-socket joint.

24. The bed frame according to claim 20, wherein each of the headboard, foot board, right side rail, and left side rail is made of a plastic material.

25. The bed frame according to claim 24, wherein the plastic material is selected from the group consisting of blow-molded plastic and rotationally-molded plastic.

26. A method of assembling a bed frame comprising the steps of:

providing a headboard, a foot board, and first and second side rails, each side rail having a first member and a second member, wherein the first member has a height dimension greater than that of the second member and serves as a guard rail;

connecting the second members of the side rails to the foot board via fastenerless connections;

releasably connecting a bracing slat between the second members so that the bracing slat extends between the first side rail and the second side rail;

connecting the first members of the side rails to the corresponding second members via fastenerless connections so that the bracing slat is releasably immobilized; and connecting the headboard to the first members of the side rails via fastenerless connections.

27. The method of assembling a bed frame according to claim 26, further comprising:

releasably inserting a first slat into opposed slat receiving wells formed in the first members of the first side rail and the second side rail so that the first slat extends between the first side rail and the second side rail.

28. The method of assembling a bed frame according to claim 27, further comprising:

releasably inserting a second slat into opposed slat receiving wells formed in the second members of the first side rail and the second side rail so that the second slat extends between the first side rail and the second side rail.

29. The method of assembling a bed frame according to claim 28, wherein the bracing slat is positioned between the first slat and the second slat.

30. The method of assembling a bed frame according to claim 26, wherein the bracing slat bisects an interior area of the bed frame defined by the foot board, the headboard, and the first and second side rails.

31. The method of assembling a bed frame according to claim 26, wherein the fastenerless connections by which the headboard is connected to the first members of the side rails are selected from the group consisting of dovetail joints, pin-in-socket joints, and combinations of dovetail joints and pin-in-socket joints.

32. The method of assembling a bed frame according to claim 26, wherein the fastenerless connections by which the second members of the side rails are connected to the foot board are selected from the group consisting of dovetail joints, pin-in-socket joints, and combinations of dovetail joints and pin-in-socket joints.

33. The method of assembling a bed frame according to claim 26, wherein the fastenerless connections by which the first members of the side rails are connected to the corresponding second members are selected from the group consisting of dovetail joints, pin-in-socket joints, and combinations of dovetail joints and pin-in-socket joints.

* * * * *